United States Patent [19]

James

[11] 4,121,636

[45] Oct. 24, 1978

[54] ADAPTOR FOR SPLITTING LOGS

[76] Inventor: Robert G. James, 3509 Janene Way, Bakersfield, Calif. 93306

[21] Appl. No.: 817,561

[22] Filed: Jul. 21, 1977

[51] Int. Cl.[2] ..... B27L 7/00

[52] U.S. Cl. ..... 144/193 R; 30/122; 30/180; 74/89.15; 74/424.8 R; 144/193 C

[58] Field of Search ..... 74/89.15, 424.8; 269/244, 247; 30/122, 180; 144/3 K, 35 A, 193 R, 193 K, 193 C, 193 D

[56] References Cited

U.S. PATENT DOCUMENTS

| | | | |
|---|---|---|---|
| 1,904,798 | 4/1933 | Nurnberger | 269/244 |
| 3,208,744 | 9/1965 | Slifer, Jr. | 269/247 |
| 3,730,008 | 5/1973 | Sheesley | 74/89.15 |

FOREIGN PATENT DOCUMENTS

| | | | |
|---|---|---|---|
| 231,752 | 4/1944 | Switzerland | 144/193 R |

*Primary Examiner*—Frank T. Yost

*Assistant Examiner*—W. D. Bray

*Attorney, Agent, or Firm*—I. Michael Bak-Boychuk

[57] ABSTRACT

Apparatus for splitting logs adapted for use with a power head of a chain saw comprising a screw jack mounted for rotation on the interior of a support channel, the input end of the screw jack being connected through a plurality of reduction gears to a drive sprocket. The screw jack itself is in turn threadably engaged to a travelling axe head conformed for sliding translation within the support channel. A part of the axe head is shaped as a wedge projecting beyond the confines of the channel to advance therealong towards a V-shaped stop bracket. An eliptical cam is mounted for rotation in the thick end of the wedge to be articulated from its narrow alignment to a broad alignment by an articulating lever disposed to advance against one of the legs of the V-shaped stop bracket. As the eliptical cam is thus rotated, expanding the lateral dimension of the axe, separation of the split is achieved.

9 Claims, 6 Drawing Figures

FIG. 1
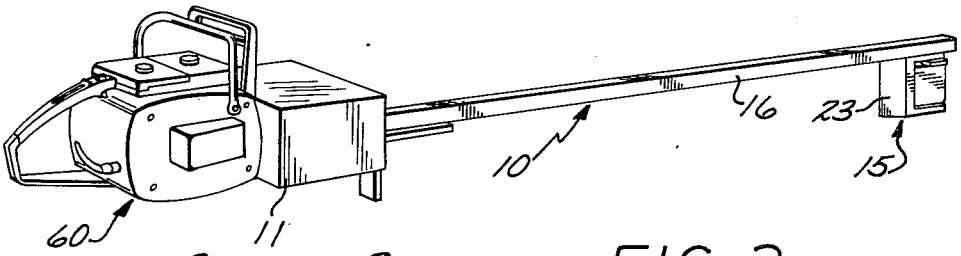
FIG. 2
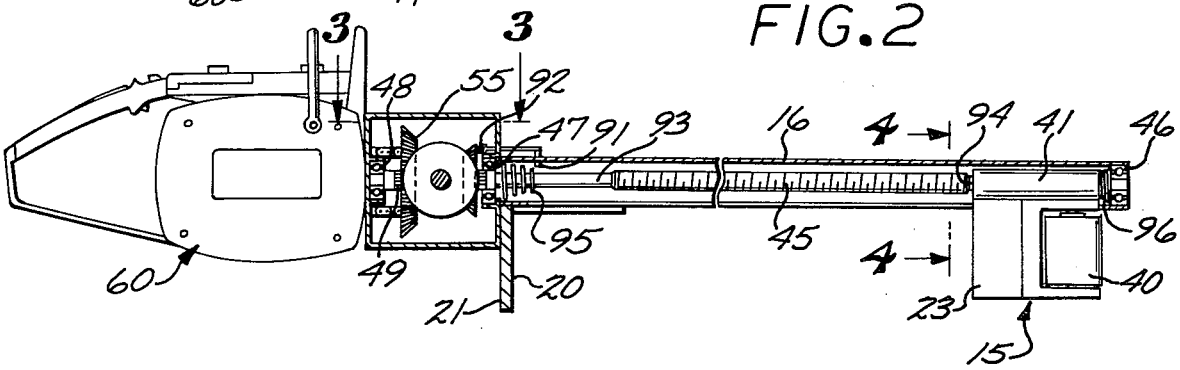
FIG. 3
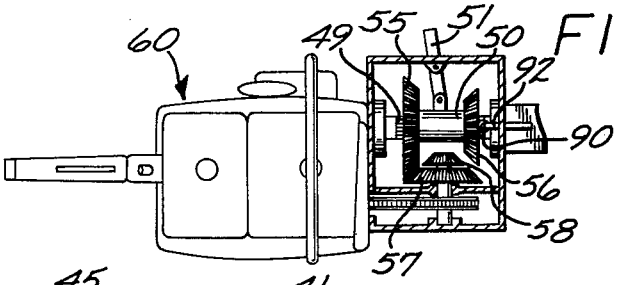
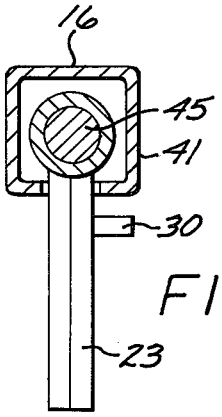
FIG. 4
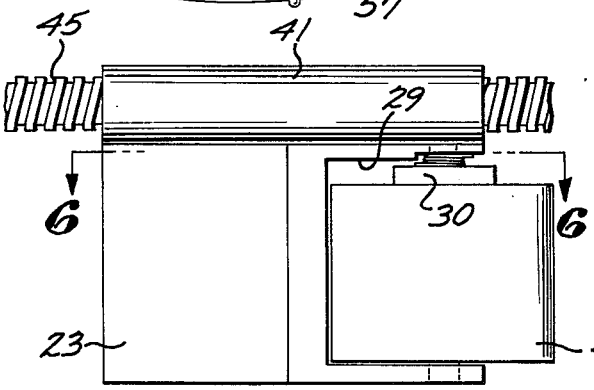
FIG. 5
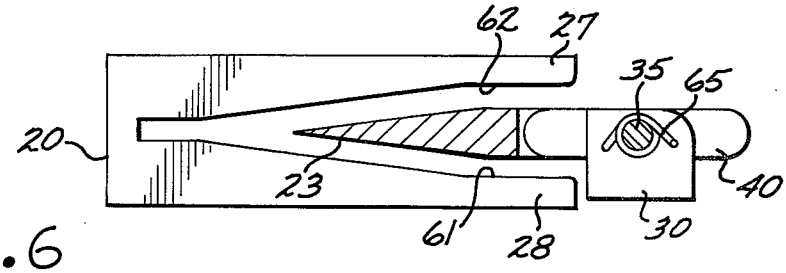
FIG. 6

ADAPTOR FOR SPLITTING LOGS

BACKGROUND OF THE INVENTION

1. Field of the Invention

The present invention relates to log splitting devices, and more particularly to log splitters adapted for use with chain saw power units.

2 Description of the Prior Art

The task of splitting logs has heretofore been achieved either by way of manually driven wedges or by wedges connected to parge power units specifically designed for such application. Most often log splitting is a function closely associated with the process of dismembering trees or branches which presently is best accomplished by chain saws. The portability of the chain saw is well recognized and the production enhancement it provides is most aptly demonstrated by the wide acceptance thereof in the logging industry. The popularity of the chain saw, in fact, reaches beyond the logging industry. This tool is presently enjoying extremely wide acceptance by the average home user. Typically a home user converts any timber cut into fire wood rather than into lumber and the task of splitting logs is therefore quite popular.

Most of the prior art log splitters either require extensive manual labor or entail complex, very expensive, power assistance, specifically designed for this unique use. Furthermore, the prior art log splitters rely on extremely high force levels in order to complete the split, the use of the wedge being the primary mode of operation. Logs, particularly those sectioned from the upper trunk of the tree, include various knots and the associated arrangement of fiber. Thus, even with the most complicated splitting devices developed in the prior art there always remains some residual labor entailed in separating fibers in order to complete the split.

SUMMARY OF THE INVENTION

Accordingly, it is the general purpose and object of the present invention to provide a log splitting attachment adapted for use with the powder unit of the chain saw, that same attachment including mechanically articulated spreaders for completing the separation of the split at the end of the splitting stroke.

Yet further objects of the invention are to provide a log splitting attachment which is universally adaptable to various rotary power sources and which is conveniently expandable in gear ratio to achieve any mechanical advances desirable.

Additional objects of the invention are to provide a log splitting attachment useful with the power head of a chain saw, this log splitting attachment being conveniently used and simple to attach.

Yet additional objects of the invention are to provide a log splitting attachment including spreading means associated therewith articulated at a predetermined point on the splitting advance.

Further objects of the invention are to provide a log splitting attachment conveniently adapted to be driven by any power source.

Yet further objects of the invention are to provide a log splitting attachment useful in substitution for the saw bar assembly of a chain saw.

Briefly these and other objects are accomplished in the present invention by supporting in rotation an advancing screw within the interior of a support channel, the advancing screw threadably engaging a travelling axe head which extends a splitting wedge to the exterior of the channel. The input end of the advancing screw is, in turn, clutched through a ratchet sliding clutch to two reduction gears disposed for alternate engagement with selected gears on a gear cluster driven in rotation by a chain drive sprocket. The chain drive sprocket is then coupled to the conventional sprocket output normally available in a chain saw power unit.

In this manner the advancing screw can be driven to advance the travelling axe head and the wedge protruding therefrom towards a V-shaped stop bracket or by alternative gearing may be utilized to withdraw the same wedge. The protruding wedge, furthermore, includes a spreader cam received within an aperture formed proximate the spine thereof, the spreader being mounted for rotation along an axis in the plane of the wedge and being secured for rotary articulation to an orthogonal lever. It is this lever that extends laterally from the surface of the wedge to engage one of the legs of the V-shaped stop, thus forcing the cam to rotate as the wedge is advanced towards the end of its stroke. By virtue of this arrangement of parts, the raised cam lobes normally confined within the structural thickness of the wedge, are rotated to project exteriorly therefrom, spreading the split at a point close to the terminal point of advancement of the axe head. This final spreading of the split assists in separating the part of the log retained between the axe head and the stop, thus providing the final separating force heretofore achieved by manual labor.

BRIEF DESCRIPTION OF THE DRAWINGS

FIG. 1 is a perspective illustration of the inventive log splitting device adapted for use with a chain saw power device;

FIG. 2 is a side view, in partial section, of the log splitting device shown in FIG. 1;

FIG. 3 is a sectional view taken along line 3—3 of FIG. 2;

FIG. 4 is yet another sectional view taken along line 4—4 of FIG. 2;

FIG 5 is a detailed view of an inventive traveling axe assembly useful with the invention herein; and FIG. 6 is a top view of the traveling axe assembly useful with the invention herein.

DESCRIPTION OF THE SPECIFIC EMBODIMENT

While the following description refers to the attachment of the inventive log splitting device to a chain saw power unit, it is to be understood that such is exemplary only. Various other power units can be conveniently modified to serve the same function and no intent to limit the scope of the invention by the example set forth is expressed.

As shown in FIG. 1, the inventive log splitting device, generally designated by the numeral 10, comprises a gear housing 11 provided with a gear selector lever 12 for selecting three modes of gearing. More specifically, gear selector 12 can assume three states, the first of which being labeled as the forward state F advancing a traveling axe head assembly generally labeled 15 along a support channel 16 towards the gear housing 11. In the second gear position labeled N, a neutral or decoupled state is achieved while a third lever position R provides the gearing in the withdrawal direction of the axe head. As shown in FIGS. 1, 2 and 6 a V-shaped stop bracket 20 is attached to the forward face of the gear enclosure 11 immediately subjacent the connection thereof with the aforementioned support channel 16.

More specifically, the stop bracket 20 comprises a vertical surface 21 opposing a cutting wedge 23 formed on the leading edge of the axe head assembly 15, the vertical surface 21 joining a horizontal surface including two longitudinal stops 27 and 28 extending to oppose a lever 30 projecting laterally from the sides of the axe head.

As shown in FIGS. 4, 5 and 6 the axe head assembly 15 includes the aforementioned wedge 23 on the leading edge thereof, the rear end of the wedge being separated by a lateral cut out 29 to form a rectangular cavity, the opposing vertical surfaces thereof pivotally supporting a vertical shaft 35 secured to a spreader cam 40. It is this cam 40 that provides the spreading function set out above for terminal separation of the split of any lumber or log placed between the wedge 23 and the opposing surface 21.

Wedge 23 and cam 40 extend from a threaded barrel assembly 41 which is disposed on the interior of the channel 16 is coaxial threaded alignment with an advancing screw 45, the tree end of the screw being mounted for rotation in a bearing 46 secured in the free end of the channel. The other end of screw 45 is in turn supported by a bearing 47 disposed on the interior surface of the gear housing 11. Shaft 45 extends beyond bearing 47 into the interior of the gear housing to be supported by yet another bearing 48 mounted on the opposing interior surface. Between the bearing 47 and 48, shaft 45 is provided with a plurality of splines 49 which engage at locating detents, a sleeve 50 disposed thereon. Sleeve 50 is connected to a handle assembly 51 terminating in the aforementioned handle 12 on the exterior of housing 11. It is by virtue of this handle 12 that the clutch 50 is translated between two engagement modes, in the first engagement mode a connection being made between a conical gear 55 mounted on shaft 45 while in the second engagement mode a gear 56 is engaged. Conical gears 55 and 56 in turn are dimensioned to respectively engage a selected one of two conical gears 57 and 58 forming a gear cluster driven in rotation by the chain sprocket 59 engaging a conventional chain extending out of the gear enclosure 11 to engage a conventional chain sprocket normally found on the powder head of a chain saw such as that illustrated herein under the general numeral 60. In this manner, the splitting assembly may be installed in substitution for the chain bar of a conventional chain saw utilizing the same power source to complete the task normally entailed in dismembering trees.

It is to be noted that the foregoing device utilizes various force multiplication features in order to adapt a power souce of any substantial size for the purposes herein. More specifically, it has been found that a 6:1 taper in the wedge 23 provides the maximum splitting effect and an overall gearing of approximately 25:1 will achieve the necessary force levels from a typical 4 or 5 cubic inch gasoline motor to split most lumber. Furthermore, the rotation of cam 40 is most effectively made close to the end of the stroke, i.e., proximate the end, this point of rotation being set by the dimensions of the two horizontal stop arms 27 and 28.

To achieve the rotation and maintain the necessary transverse alignment of the spreader cam 40, the lever 30 is formed as an integral structure with the cam, lever 30 forming a transverse edge offset from the axis of pin 35 to abut a parallel interior edge segment 61 on the end segment of stop arm 28, on rotation. Similarly arm 27 includes a substantially parallel interior edge segment 62 dimensioned to abut the trailing edge of the lever 30, the leading and trailing edges of this lever being thus conformed for aligning receipt between the corresponding interior edge segments 61 and 62. To further facilitate this rotation of the spreader cam 40, it is intended to round the interior corners of the ends of the stop arms 27 and 28, the trailing edge of lever 30 being similarly rounded for pivotal receipt therebetween. Furthermore, in order to maintain the alignment of the spreader cam 40 within the confines of the wedge 23 prior to this spreading rotation, a coil spring 65 is engaged between the lever 30 and the upper surfaces of cut out 29.

To preclude the possible jam up as result of overdriving of the axe head assembly 15 against the limits of its stroke shaft 45 includes smooth, unthreaded segments 93 and 94 proximate the ends thereof, segments 93 and 94 being somewhat longer than the threaded wedge head 41. Surrounding each segment 93 and 94 and abutting the corresponding support bearings 47 and 46 are two helical springs 95 and 96 which urge the axe head assembly 15 back into threaded engagement for the returning stroke. As an adjunct, or in the alternative, an actuation rod 92 may be utilized, extending a detent 91 into the interior of channel 16. As the axe head assembly 15 advances towards the gear housing 11 rod 92 is inwardly displaced to press one end thereof terminating in a roller 90 against the gear 56, thus engaging the gearing.

By way of the foregoing arrangement of parts the alignment of the spreader cam is maintained in the kerf or split formed by the leading wedge, thus presenting very little added burden on the power unit. Once the log has been split to the depth set by the length of the stop arms 27 and 28 the base width of the wedge 23 on the leading edge of the axe head assembly 15 ensures a forward propogation of the split with the result that little additional force is required in order to rotate the cam. Upon rotation of the cam the residual fibers normally found in every splitting operation are separated by the full width of the cam. The advantages of this implementation are therefore immediately perceivable. Beside adapting to an existing power source the present invention provides the additional feature of completing the split, a feature not usually found in most of the present devices.

Furthermore, by selective control over the dimensions of the wedge and the two stop arms, this spreading operation occurs at a point when the opposing forces within the log are at their minimum. Thus the power requirements necessary in order to achieve this function are evenly distributed along the stroke, utilizing to best advantage the common power units found in the market place.

Obviously, many modifications and variations to the above disclosure can be made without departing from the spirit of the invention. It is therefore intended that the scope of the invention be determined solely dependent on the claims attached hereto.

What is claimed is:

1. Apparatus for splitting wood and comprising:

power means including a housing and an output for producing rotary power;

an elongate support member adapted for operative attachment to said housing of said power means at one end thereof;

a threaded advancing shaft supported for rotating between the ends of said support member;

gearing means deployed between said advancing shaft and said power means for selective coupling therebetween;

stopping means attached to said support member proximate said one end thereof and extending along said threaded shaft; and a wedge threadably engaged to said advancing shaft and disposed to radially project therefrom in longitudinal alignment, the apex of said wedge forming the leading edge thereof being aligned towards said stopping means, said wedge being threadably translated along said shaft upon coupling thereof to said power means by gearing means, said wedge further including a rotary spreader cam within the trailing edge thereof spring biased to a first rotary position and actuatable by said stopping means towards a second rotary position upon the advance of said wedge along said shaft towards said stopping means.

2. Apparatus according to claim 1 wherein:

said stopping means comprises a bracket disposed to provide a first surface substantially orthogonal to said support member and a second surface substantially parallel therewith said second surface including two substantially coplanar leg members separated by a gap and aligned to extend in opposition towards said wedge, and said wedge includes a transverse cutout in said trailing edge thereof conformed to support in rotation said spreader cam therebetween.

3. Apparatus according to claim 2 wherein:

said spreader cam includes a lever extending transversely therefrom for engaging one of said leg members upon translation of said wedge towards said stopping means, said lever being aligned to rotate said cam from said first position towards said second position upon engagement of one of said leg members.

4. Apparatus according to claim 3 wherein:

said lever is conformed for receipt between said leg members upon rotation of said cam to said second position.

5. Apparatus according to claim 3 wherein:

said stopping means further includes an actuating rod disposed to actuate said gearing means and aligned for engagement by said wedge for disengaging said gearing means from said advancing shaft upon a predetermined advancement of said wedge towards said stopping means.

6. A powered wood splitter including a source of power and a frame including a stop adapted to oppose one end of said wood, the improvement comprising:

a wedge supported for translation on said frame and operatively connected to said source of power for advancement towards said stop, said wedge including a pointed leading edge aligned in opposition to said stop and a blunt trailing edge, a cam mounted for rotation along said trailing edge, said cam having a first sectional dimension smaller than the transverse dimension of said trailing edge and a second sectional dimension larger than the transverse dimension of said trailing edge, and a lever connected to said cam and aligned for engagement by said stop for rotating said cam to align said second sectional dimension thereof transverse to said wedge at a predetermined point of advancement of said wedge towards said stop.

7. Apparatus according to claim 6 further comprising:

disengaging means operatively connected to said frame and said source of power for disengaging said source of power upon a preselected point of advancement of said wedge towards said stop.

8. Apparatus for splitting wood segments, comprising:

a source of power including a housing; frame means connected in cantilever to said housing including a first rotational support proximate the free end thereof and a second rotational support proximate said housing;

a threaded shaft mounted for rotation in said first and second rotational supports;

gearing means disposed for selective coupling between said source of power and said shaft;

a wedge threadably engaged to said shaft for advancement thereon upon the rotation thereof by said gearing means; and stopping means coupled to said gearing means and deployed on said frame proximate said housing and aligned to oppose said wedge along the advancement thereof towards said housing for disengaging said gearing means from said shaft upon a preselected advance of said wedge.

9. Apparatus according to claim 8 wherein:

said shaft includes first and second reduced diameter cylindrical segments respectively proximate said first and second rotational support, each segment being conformed for sliding translation of said wedge therealong, and a first and second spring respectively disposed around said first and second segments for urging said wedge away from said first and second rotational supports into threaded engagement with said shaft.

* * * * *